US006527505B2

(12) United States Patent
Yu et al.

(10) Patent No.: US 6,527,505 B2
(45) Date of Patent: Mar. 4, 2003

(54) REGENERATIVE FUEL PUMP FLOW CHAMBER

(75) Inventors: DeQuan Yu, Ann Arbor, MI (US); Paul E. Fisher, Dexter, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/734,986

(22) Filed: Dec. 11, 2000

(65) Prior Publication Data

US 2002/0071759 A1 Jun. 13, 2002

(51) Int. Cl.[7] ..... F04D 5/00
(52) U.S. Cl. ..... 415/55.1
(58) Field of Search ..... 415/55.1, 55.2, 415/55.3, 204, 206; 123/497; 417/423.3, 423.14

(56) References Cited

U.S. PATENT DOCUMENTS 5,221,178 A 6/1993 Yoshioka et al.
5,338,151 A * 8/1994 Kemmner et al. ..... 415/55.1
5,904,468 A 5/1999 Dobler et al.
5,921,746 A 7/1999 Yu et al.
5,961,276 A * 10/1999 Huebel et al. ..... 415/55.1
6,152,686 A * 11/2000 Neidhard et al. ..... 415/55.1
6,152,688 A * 11/2000 Staab et al. ..... 415/55.5
6,162,012 A * 12/2000 Tuckey et al. ..... 415/55.1

* cited by examiner

*Primary Examiner*—Edward K. Look
*Assistant Examiner*—Ninh Nguyen
(74) *Attorney, Agent, or Firm*—Brinks Hofer Gilson & Lione

(57) ABSTRACT

A fuel pump for pumping fuel from an inlet port to an outlet port. In one embodiment, a housing made up of a body piece and a cover piece encloses an impeller. The impeller has a vaned periphery and an outer ring connected by spokes. An inlet hole is defined within the cover piece for fuel to enter the pump. An outlet hole is defined within the body piece for fuel to exit the pump into an internal chamber. A first main semicircular shaped channel is defined circumferentially into the cover piece and extends in an annular fashion around the cover piece. The body piece has a second main semicircular channel as well as at least one annular groove. In the preferred embodiment of the invention, there are two annular grooves, one connected directly to the second semicircular channel, and one around the peripheral edge of the body piece at the point where it contacts the cover piece.

25 Claims, 7 Drawing Sheets

REGENERATIVE FUEL PUMP FLOW CHAMBER

FIELD OF THE INVENTION

This invention relates generally to the field of pumps, in particular pumps for automotive vehicles, that are designed to pump liquid fuel from a tank through a fuel system to an engine.

BACKGROUND OF THE INVENTION

In a vehicle powered by an internal combustion engine, a motor operated fuel pump may pump liquid fuel from a tank through a fuel system to the engine. Typically, fuel pumps such as those in the prior art utilize a rotating impeller driven by a motor to move fluid from an inlet port to an outlet port.

In part due to particulate contaminants that are present in liquid fuel such as conventional-grade gasoline, the parts of the fuel pumps may become worn as the particulates contact surfaces of moving parts or componentry near these parts at high speed. This decreases the efficiency of the pump and, in some cases, can lead to pump failure. Especially effected are the plastic impellers used by these fuel pumps. The pumping chamber walls may also become worn, creating a greater space than is necessary between the impeller and the walls of the pump and thereby further reducing efficiency.

U.S. Pat. No. 5,921,746 attempted to solve this problem using a new guiding technique wherein particulate and other contaminants are routed into a separate contaminate channel, thereby keeping them away from the impeller. However, the special channel is difficult to manufacture, as it must be machined to have a varying depth such that the depth of the channel decreases as the contaminants travel to the end of the channel. The dimensional requirements of this channel are also not conducive to mass production, thereby resulting in increased costs for manufacturing the pump.

BRIEF SUMMARY OF THE INVENTION

The present invention provides, in one embodiment, a fuel pump for pumping fuel from an inlet port to an outlet port. A housing made up of a body piece and a cover piece encloses an impeller. The impeller has a vaned periphery and an outer ring connected by spokes. An inlet hole is defined within the cover piece for fuel to enter the pump. An outlet hole is defined within the body piece for fuel to exit the pump into an internal chamber. A first main semicircular shaped channel is defined circumferentially into the cover piece and extends in an annular fashion around the cover piece. The body piece has a second main semicircular channel as well as at least one annular groove. In the preferred embodiment of the invention, there are two annular grooves, one connected directly to the second semicircular channel, and one around the peripheral edge of the body piece at the point where it contacts the cover piece.

In a further embodiment of the invention, the main channel in the cover begins at the inlet hole and the main channel in the body ends at the outlet hole, allowing the fuel to enter and leave the chamber. The end of the main channel in the cover expands outwardly at the end, and inclines upwardly, ramping towards the impeller. The end of the main channel in the cover aligns with the end of the main channel in the body opposite the outlet hole. An annular groove is in fluid communication with the main channel in the body via the outlet hole and at the portion of the channel in the body that aligns with the expanded potion of the channel in the cover. In the preferred embodiment of the invention, the other annular groove is in fluid communication with the main channel in the cover when the pieces are assembled.

In the present invention the annular grooves preferably are of a constant depth. This allows for simplified, economical manufacturing. There is also a space between the impeller and the outer wall of the body piece such that the space contacts the annular grooves when the pump is assembled.

Another embodiment of this invention has the same general features as the embodiment above, but the second annular groove is machined into the cover piece instead of the outer edge of the body piece. This annular groove contacts the expanded portion of the first main semicircular channel and at another point at the inlet hole.

In yet another embodiment of the invention, generally the same features are provided as in the embodiments above, but the housing is one solid piece, rather than a body and a cover piece. The first annular groove and first main semicircular channel are machined into the housing below the impeller. The second annular groove and second main semicircular channel are machined into the housing above the impeller.

The invention may also be embodied in a method for substantially preventing contaminants in liquid fuel from coming into contact with a substantial portion of a vaned impeller. The method includes the steps of routing the contaminants into annular grooves that are connected to the main semicircular channels in the body and the cover pieces. The contaminants are retained within the annular grooves and away from the impeller vanes before being expelled with the rest of the liquid fuel through an outlet.

In the present invention, the annular grooves allow for the contaminants to substantially avoid the impeller, thus reducing wear on the pump parts and maintaining a higher efficiency. Furthermore, since the annular grooves are kept at a constant depth, they are efficient to machine. This allows for effective mass production of the fuel pump.

It is to be understood that both the preceding summary and the following detailed description are intended to be exemplary and explanatory and are intended to provide a further explanation of the invention claimed. The invention will be best understood by reference to the following detailed description read in conjunction with the accompanying drawings.

BRIEF DESCRIPTION OF SEVERAL VIEWS OF THE DRAWINGS

These and other advantages of the present invention will become more fully apparent as the following description is read in conjunction with the accompanying drawings, wherein.

DETAILED DESCRIPTION OF THE PREFERRED EMBODIMENT

Figure 1:
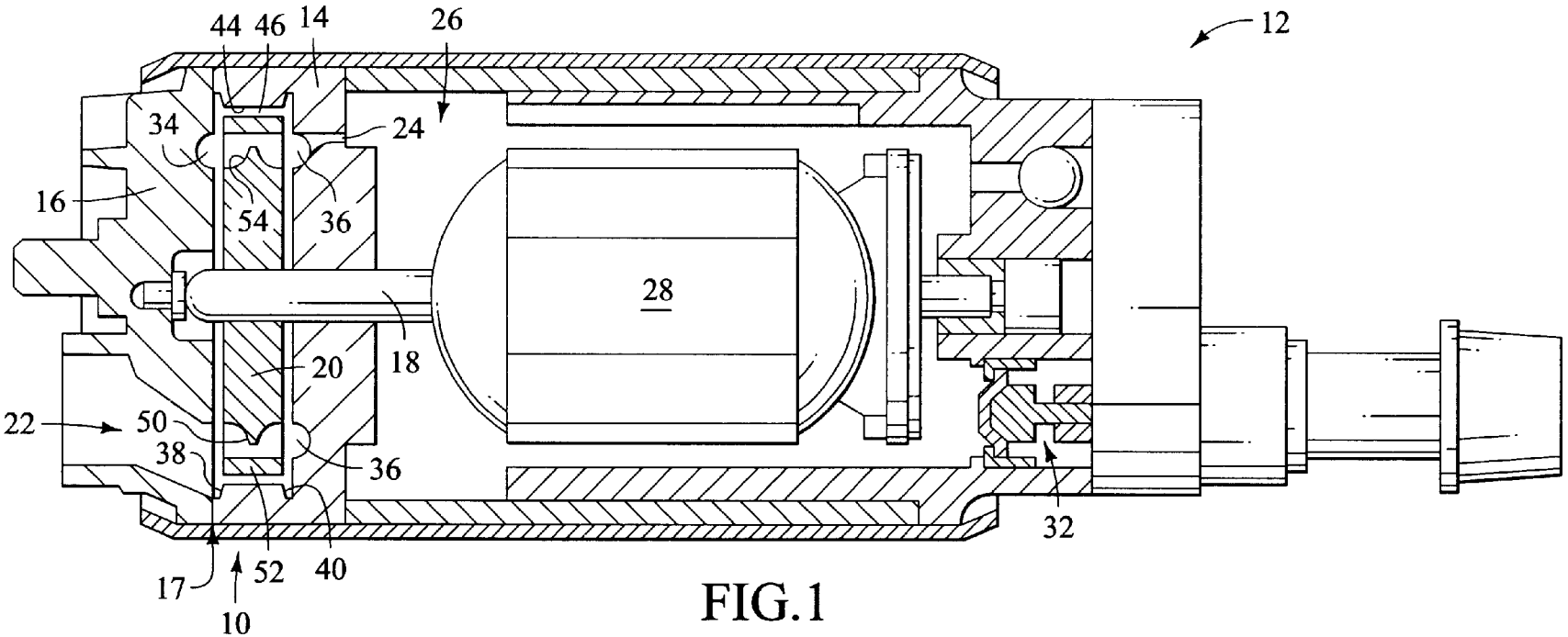
FIG. 1 shows a cut away view of an embodiment of the present invention in a standard fuel pump.

Referring to the figures, FIG. 1 shows the fuel pump assembly 10 contained within an automotive fuel pump 12. The body piece 14 and the cover piece 16 are preferably assembled around a shaft 18 and house a pumping element in the form of an impeller 20. The impeller 20 rotates with the shaft 18 when the pump is in operation. An inlet hole 22 is defined in the cover piece 16 and an outlet hole 24 is defined in the body piece 14, which opens into an inner chamber 26. Disposed in the inner chamber is an electric motor 28 that rotates the shaft 18, thereby rotating the impeller 20 along the axis of the shaft 18. A space 46 is defined between the impeller 20 and the outer wall 44. During operation, the impeller 20 rotates, drawing fuel through the inlet hole 22, through the fuel pump assembly 10, out the outlet hole 24 and into the inner chamber 26. From the inner chamber 26, the fuel passes out through an exit tube 32 and in turn is sent to the engine that is not pictured.

Also shown in FIG.1 are the first main semicircular channel 34 and the second main semicircular channel 36 defined within the cover piece 16 and the body piece 14, respectively. The first main semicircular channel 34 preferably extends partially around the circumference of the cover piece 16. The second main semicircular channel 36 preferably extends partially around the circumference of the body piece 14 and is parallel to the first main semicircular channel 34. When the fuel pump 10 is in operation, the impeller 20 forces fuel through these channels 34, 36. The first annular groove 38 and the second annular groove 40 are the contamination collection channels. Their function will be described more fully in reference to FIG. 6.

Figure 3:
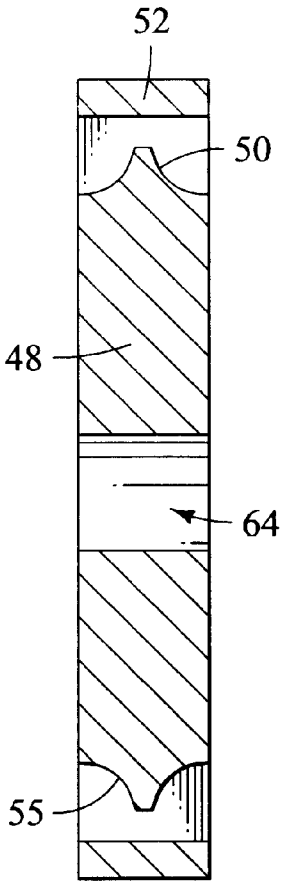
FIG. 3 shows a cut away view of the impeller shown in FIG. 2 along line 3—3 of FIG. 2.
Figure 2:
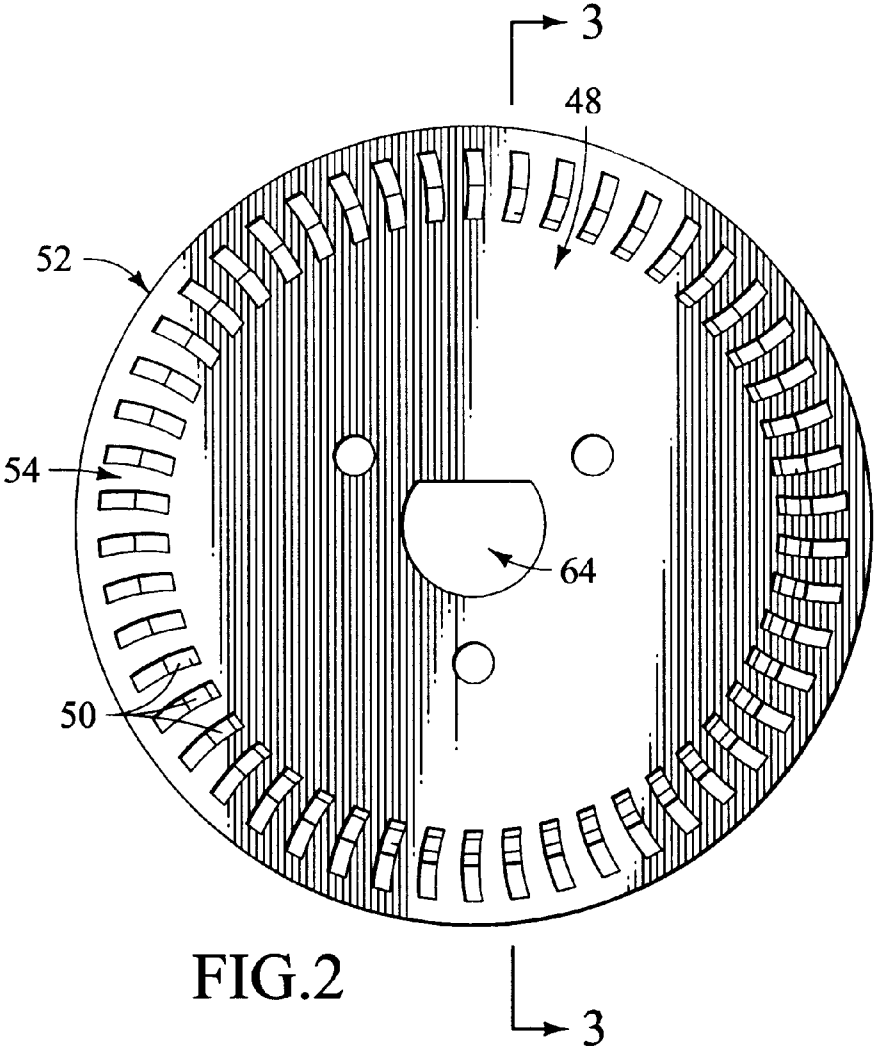
FIG. 2 shows an embodiment of the impeller of the present invention viewed from above.

FIG. 2 shows a side view of the impeller 20 removed from the fuel pump 10. The impeller 20 has a main impeller body 48 that contains a plurality of annularly spaced vanes 50 along its periphery. A ring 52 is defined radially outwardly of the vanes 50, and connected to the main impeller body 48 by spokes 54. The shaft 18 extends through a hole 64 defined in the center of the main impeller body 48. FIG. 3 shows a cross section of the impeller 20 along line 3—3 of FIG. 2. The impeller vanes 50 can be seen as well as the outer ring 52. The impeller vanes 50 have curved sections 55 that help increase fuel swirling when the shaft 18 rotates the impeller 20.

Figure 4:
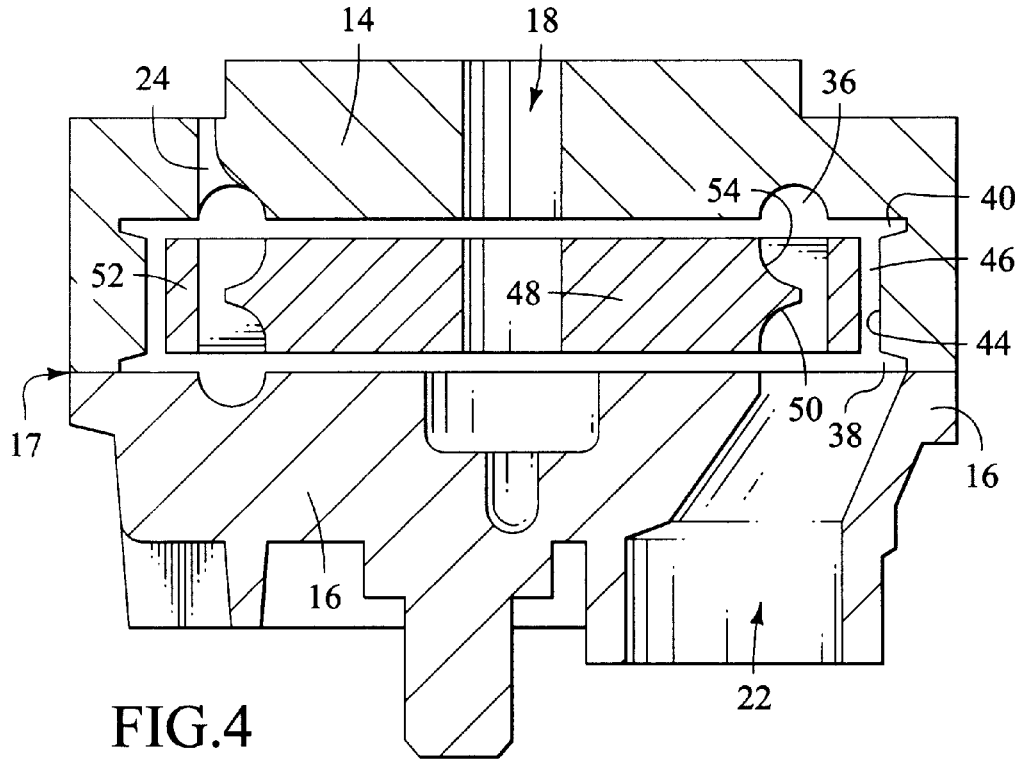
FIG. 4 shows a cut away view of an embodiment of the present invention.
Figure 5:
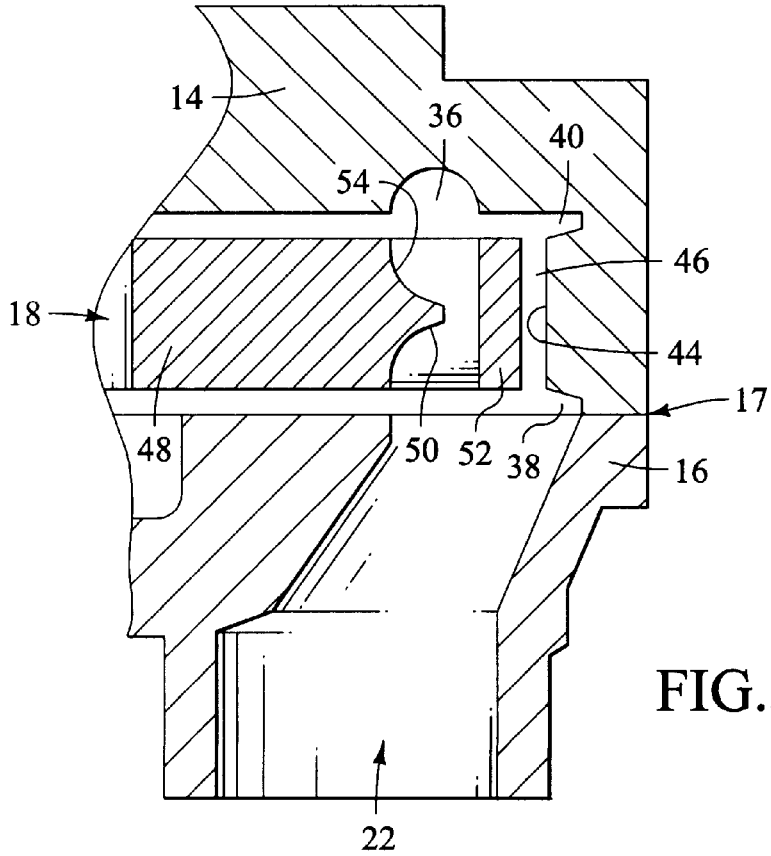
FIG. 5 shows a cut away enlarged view of an embodiment of the present invention showing the annular grooves.

FIGS. 4 and 5 illustrate enlarged views of the fuel pump assembly 10. The cover piece 16 and the body piece 14 are assembled to contact each other at line 17 around the shaft 18. As shown, the first main semicircular channel 34 and the second main semicircular channel 36 are preferably aligned with the impeller vanes 50 and lay parallel to each other. The curvature of the first and second main semicircular channels 34, 36 preferably corresponds closely with the curved sections 55 of the impeller vanes 50.

Figure 6:
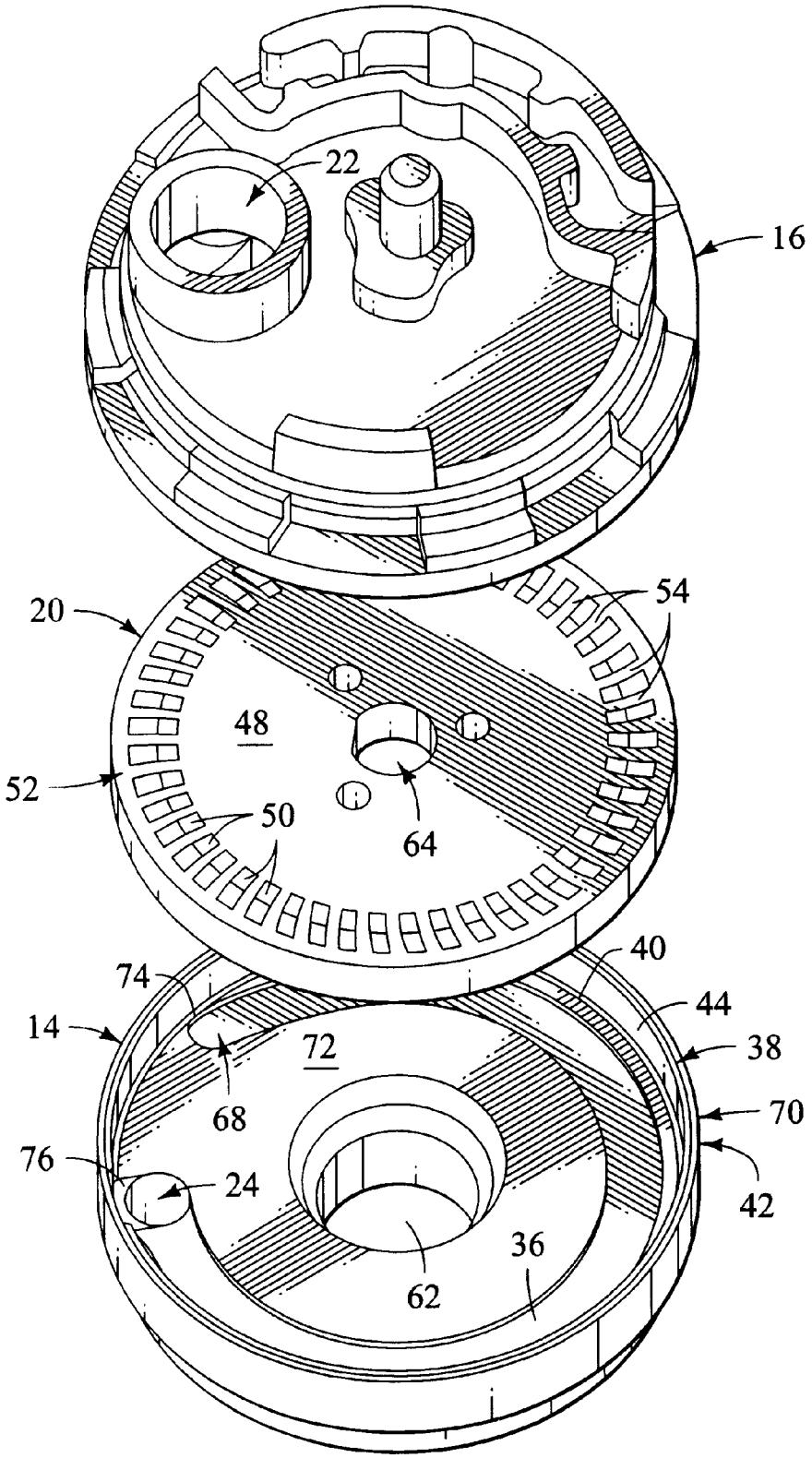
FIG. 6 shows an exploded view of an embodiment of the present invention showing the body piece on the bottom.

FIG. 6 shows the fuel pump assembly 10 in an exploded state with the body piece 14 on the bottom. The first annular groove 38 and the second annular groove 40 are defined along a top edge 42 of an outer wall 44 and the face 72 of the body piece 14, respectively. These annular grooves 38, 40 allow for contaminants in the liquid fuel to be routed around the impeller 20 when the fuel is traveling through the first main semicircular channel 34 and the second main semicircular channel 36. The contaminants are in turn routed to the outlet 24 through a section 76 connected to the outlet 24.

Figure 7:
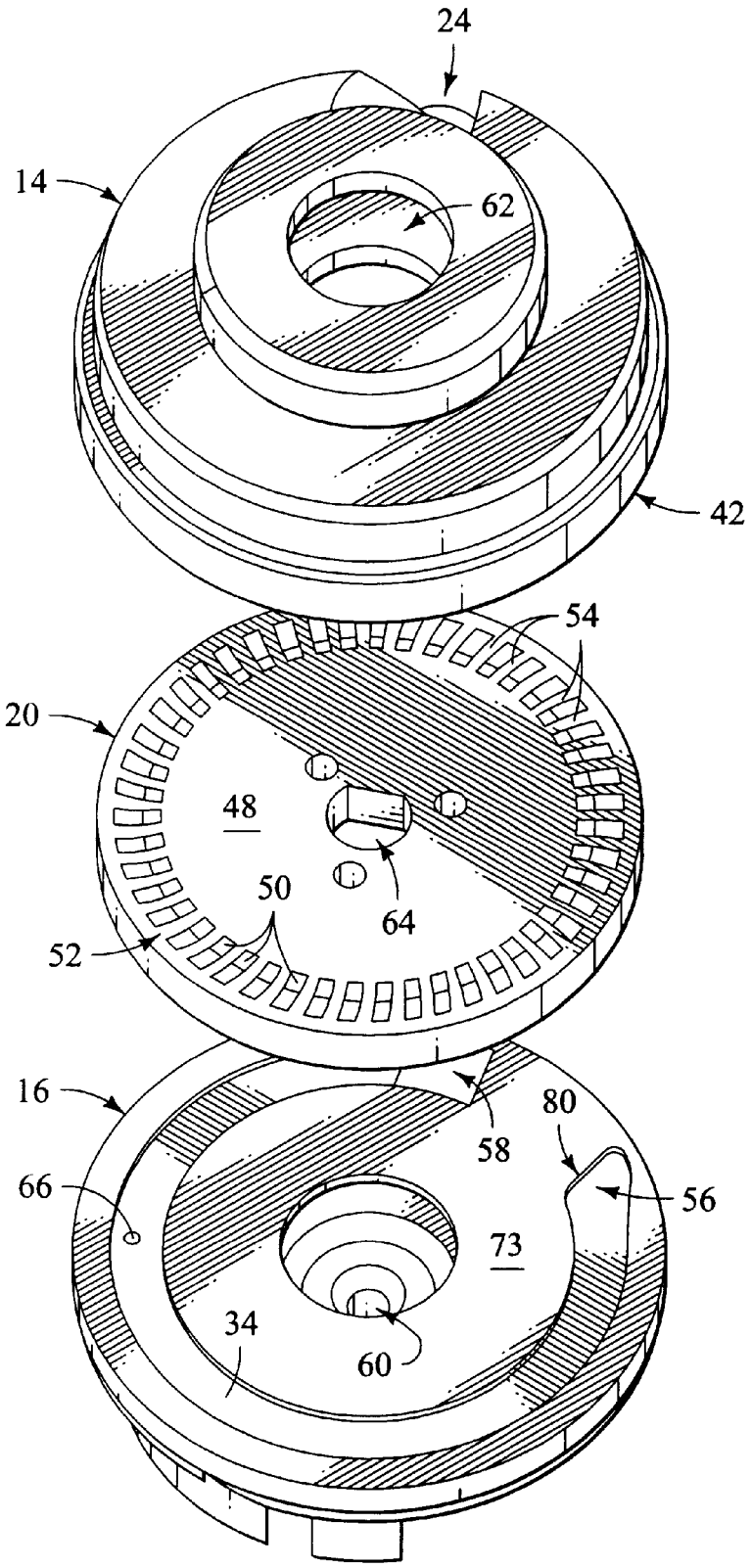
FIG. 7 shows an exploded view of an embodiment of the present invention showing the cover piece on the bottom.

FIG. 7 is also an exploded view, but inverted from FIG. 6 with the cover piece 16 on the bottom of the Figure. In FIG. 7, the first main semicircular channel 34 is shown in the cover piece 62. This channel 34 begins at the inlet hole 58 and preferably continues annularly approximately 330 degrees around the cover piece. At the end opposite the inlet hole 22, the first main semicircular channel 34 defines an expanded section 56. This section 56 expands outwardly, following the shape of the machined out section 76 in the body piece 14. The end 80 of the of the expanded section 56 has an upward transition 82 ramped toward the impeller 20, which can be seen in FIG. 11 and will be discussed in detail in reference to that Figure. This view also shows opening 60 defined in the cover piece 16, the opening 62 defined in the body piece 14 and the opening 64 defined in the impeller 20 through which the shaft 18 is passed. An opening 66 for releasing bubbles trapped in the fuel is also defined on the cover piece 16. One skilled in the art will appreciate that the openings 60, 62, 64, 66 are conventional in the prior art.

Figure 9:
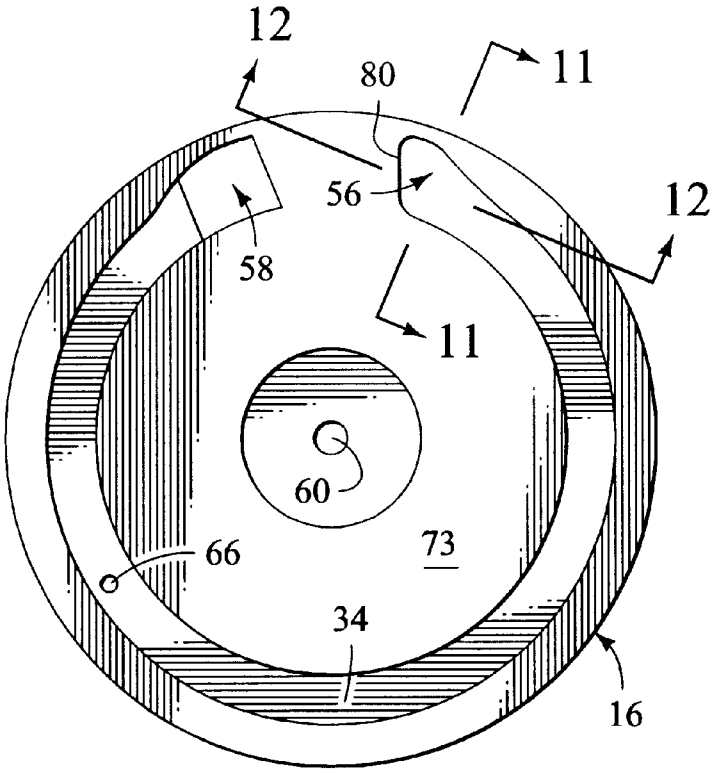
FIG. 9 shows the cover piece shown in FIGS. 7 and 8 viewed from above.
Figure 8:
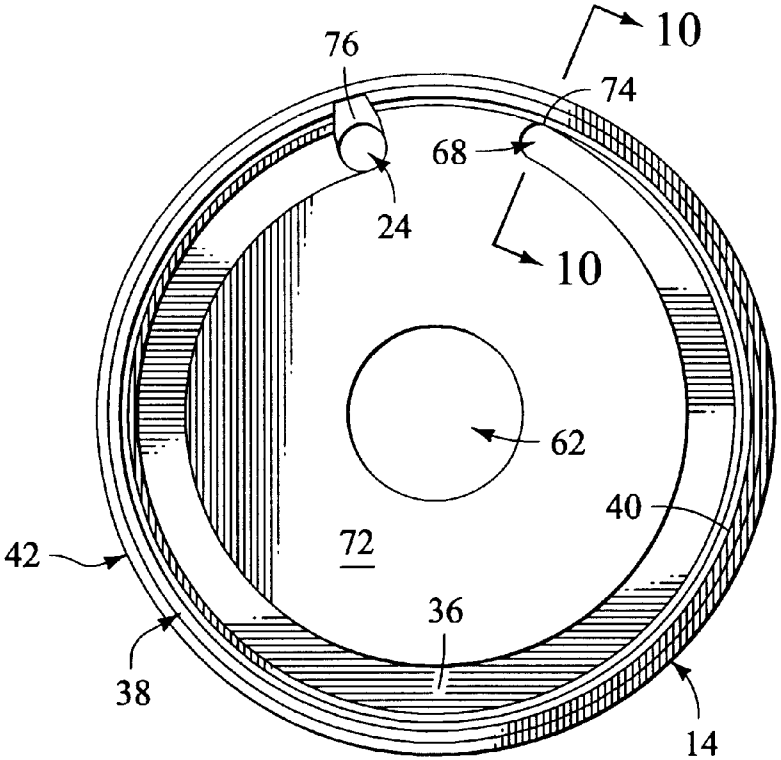
FIG. 8 shows the body piece shown in FIGS. 7 and 8 viewed from above.

As shown in FIG. 6, the second main semicircular channel 34 begins at a rounded off section 68 which preferably aligns with the inlet hole 22 on the cover piece 16 when the body piece 14 and the cover piece 16 are assembled. The second main semicircular channel 36 preferably extends approximately 330 degrees around the body piece 14. The first annular groove 38 is located on the peripheral edge 70 of the body piece 14 and extends around the entire outside edge of the body piece 14. The second annular groove 40 is defined on the face 72 of the body piece 14, and substantially corresponds to and traces the path of the second main semicircular channel 36. Preferably, the second annular groove 40 connects with the second semicircular channel 36 at two points. The first connection point 74 between the second annular groove 40 and the second main semicircular channel 36 is at a rounded off section 68. The second connection point 76 is defined adjacent to the outlet hole 24, where a section is machined out from the outlet hole 24 to contact the second annular groove 40. These connection points allow for the contaminants to enter and exit the second annular groove 40. FIGS. 8 and 9 show the body piece 14 and the cover piece 16 viewed from above.

Figure 10:
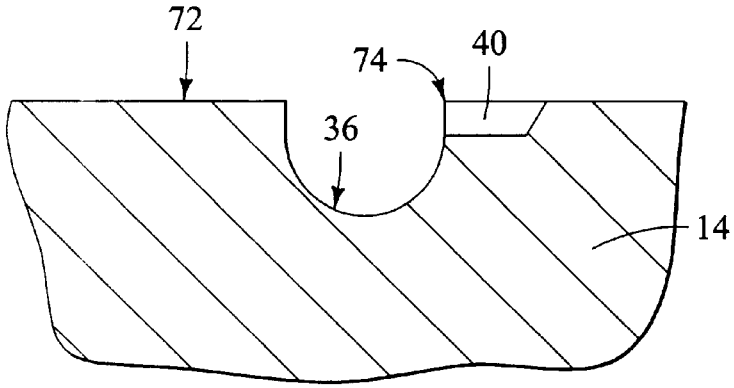
FIG. 10 shows a cross-sectional view of the second main semicircular channel and the second annular groove at their connection point on the body piece shown in FIG. 8 along line 10—10 of FIG. 8.

FIG. 10 shows the shape of both the second main semicircular channel 36 and the second annular groove 40 at the connection point 74 as viewed along line 10—10 in FIG. 8. As seen in this view, the second annular groove 40 is preferably shallower than the second main semicircular channel 36. The shallowness of the annular grooves 38, 40 helps maintain pump efficiency. The depth shown here of the second annular groove 40 is constant throughout the second annular groove 40. The depth of the first annular groove 38 is preferably identical. The constant depths of the first 38 and second 40 annular grooves make this embodiment of the invention easy to mass-produce and keeps costs down.

Figure 11:
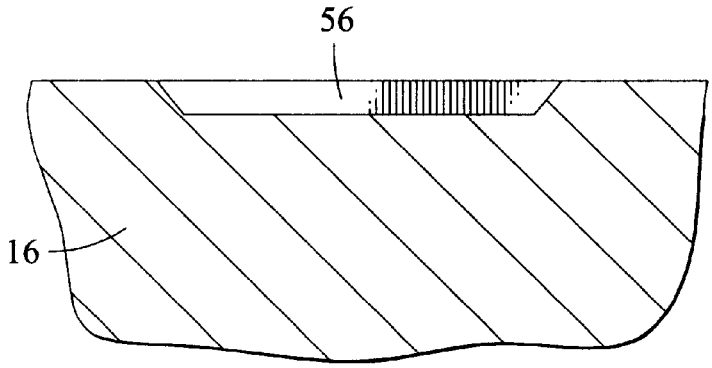
FIG. 11 shows a cross sectional view of the expanded portion of the first main semicircular channel shown in FIG. 9 along line 11—11 of FIG. 9.
Figure 12:
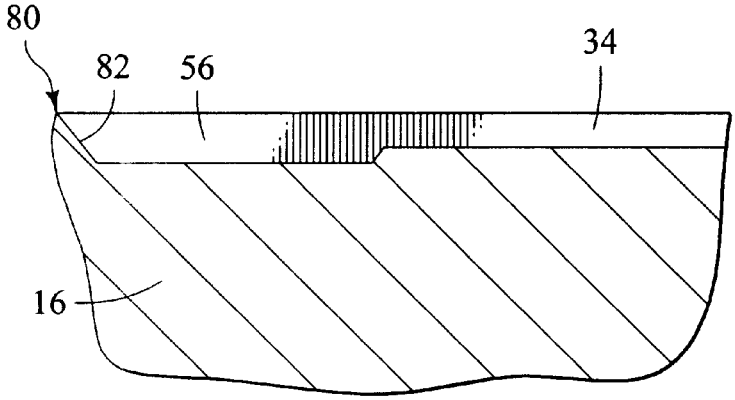
FIG. 12 shows a cross sectional view of the expanded portion of the first main semicircular channel shown in FIG. 9 along line 12—12 of FIG. 9.

FIG. 11 shows the expanded portion 56 of the first main semicircular channel 34 viewed along line 11—11 in FIG. 9. This displays that the expanded portion 56 of the first main semicircular channel 34 departs from the semicircular shape of the first main semicircular channel 34. FIG. 12 shows the expanded potion 56 of the first main semicircular channel 34 as well, but along line 12—12 in FIG. 9. This view shows the far end 80 of the expanded portion 56 of the first main semicircular channel 34 and displays an upward transition 82 ramped toward the impeller 20. This upward transition 82 forces the fuel flow up through the impeller vanes 50 and out the outlet hole 24. Some of the contaminants, meanwhile, are forced by centrifugal force into the first annular groove 38, though a section 76 connected to the outlet hole 24, and out the outlet hole 24 with the rest of the fuel, thus substantially avoiding the impeller vanes 50.

Referring now in combination to FIGS. 1–3 and 6, the motor 28 rotates the impeller 20 during operation of the fuel pump 10. The vanes 50 create a pressure differential between the inlet hole 22 and the outlet hole 24 which draws fuel through the pump assembly 10 along two separate paths. In the first fuel pathway, the fuel is drawn through the inlet hole 22, through the first main semicircular channel 34, up between the vanes 50 of the impeller 20, and out the outlet hole 24. Contaminants along this fuel path are forced into the first annular groove 38 by centrifugal force and remain in the first annular groove 38 until reaching a section 76 machined out from the outlet 24 to contact the first annular groove 38. From the connecting section 76, the contaminants pass out through the outlet hole 24.

In the second pathway, the fuel is drawn through the inlet hole 22, directly up between the vanes 50 of the impeller 20, into the second main semicircular channel 36, and out the outlet hole 24. Contaminants along this fuel path are forced into the second annular groove 40 by centrifugal force, and remain in the second annular groove 40 until reaching a section 76 machined out from the outlet 24 to contact the second annular groove 40. From the connecting section 76, the contaminants pass out through the outlet hole 24. These two pathways allow the contaminants to substantially avoid the impeller 20 and wear on the impeller spokes 54 and the outer ring 52 is substantially reduced.

In the preferred embodiment, the depth of the first main semicircular channel 34 is 0.8–1.4 mm for an impeller 20 having a circumference of 32 mm and a thickness of 2.54 mm. The width of the first main semicircular channel 34 is 3.2 mm. The width of the expanded portion 56 of the first main semicircular channel 34 is 4.0–5.0 mm with a depth of 0.8–1.4 mm. For the second main semicircular channel 36, the depth is 0.8–1.4 mm and the width is 3.2 mm and is kept constant throughout the second main semicircular channel 36. The main semicircular channels 34, 36 extend at an arc of 330 degrees around the faces 72, 73 of the cover 16 and the body 14 pieces. Also, the depth of the annular grooves 38, 40 is 0.2–1.0 mm with a width of 1.0 mm. Each extends around the perimeter of the impeller 20 at an arc of 330 degrees. An impeller 20 with the dimensions above should be mounted such that the space 46 between the impeller 20 and the outer wall 46 has a measurement of 0.15 mm. These elements are only exemplary, of course, and it is important to note that other dimensions may be utilized without departing from the scope of the present invention.

It should be understood that there are a wide range of changes and modifications that could be made to the embodiment described above. In particular, the first annular groove 38 could be machined directly into the cover piece 16, extending arcuately from the first main semicircular channel. Or, the housing could be one solid piece instead of separate body and cover pieces 14, 16. The shape and length of the main semicircular channels 34, 36 could be adjusted as well, as could the shape and length of the annular grooves 38, 40 to suit the needs of the user. Other types of impellers could replace the impeller 20 shown. Finally, only one annular groove could be used rather than two. The groove could be positioned either above or below the impeller 20. Thus it is intended that the forgoing detailed description be regarded as illustrative rather than limiting and that it be understood that it is the following claims, including all equivalents, which are intended to define the scope of the invention.

What is claimed is:

1. A pump comprising:

a housing having a body piece and a cover piece forming an internal chamber;

an impeller disposed within said internal chamber;

an inlet hole defined within one of said cover piece and said body piece;

an outlet hole defined within the other of said body piece and said cover piece;

a first main semicircular channel fluidly connected to said internal chamber and extending annularly around at least a portion, wherein said first main semicircular channel expands outwardly at one end and terminates in an upward incline ramped towards said impeller;

a second main semicircular channel fluidly connected to said internal chamber and extending annularly around at least a portion; and at least one annular groove extending around a periphery of at least one of said body piece and said cover piece, said at least one annular groove spaced radially outwardly from an edge of said impeller and being fluidly connected to at least one of said first main semicircular channel and said second main semicircular channel.

2. A pump according to claim 1, wherein a first annular groove extends around a periphery of said cover piece, said first annular groove spaced radially outwardly from an edge of said impeller and being fluidly connected to said first main semicircular channel and a second annular groove extends around a peripheral edge of the inside of said body piece, and said second annular groove extending parallel to said first annular groove and being fluidly connected to said second main semicircular channel.

3. A pump according to claim 2, wherein said second annular groove is in fluid communication with said second main semicircular channel at a point adjacent to said outlet hole.

4. A pump according to claim 2, wherein said second annular groove is in fluid communication with said second main semicircular channel at a point adjacent to an end of said second main semicircular channel.

5. A pump according to claim 2, wherein said first annular groove is in fluid communication with said expanded portion of said first main semicircular channel when said body and cover pieces are combined.

6. A pump according to claim 2, wherein said first annular groove is in fluid communication with an end of said first main semicircular channel at a point near said inlet hole when said body and cover pieces are combined.

7. A pump according to claim 1, wherein said first main semicircular channel and said second main semicircular channel extend approximately 330 degrees around one side of each of said cover and body pieces.

8. A pump according to claim 1, wherein said first main semicircular channel has a first end in fluid communication with said inlet hole and a second end.

9. A pump according to claim 4, wherein said second main semicircular channel has a first end substantially aligned with said second end of said first main semicircular channel and a second end in fluid communication with said outlet hole when said body and cover pieces are combined.

10. A pump according to claim 1, wherein said at least one annular groove remains at a substantially constant depth.

11. A pump comprising:

a housing having a body piece and a cover piece forming an internal chamber;

an impeller disposed within said internal chamber;

an inlet hole defined within one of said cover piece and said body piece;

an outlet hole defined within the other of said body piece and said cover piece;

a first main semicircular channel fluidly connected to said internal chamber and extending annularly around at least a portion of one side of said cover piece, wherein said first main semicircular channel expands outwardly at one end and terminates in an upward incline ramped towards said impeller;

a second main semicircular channel fluidly connected to said internal chamber and extending annularly around at least a portion of one side of said body piece; and at least one annular groove extending from at least one of said first main semicircular channel and said second main semicircular channel.

12. A pump according to claim 11, wherein a first annular groove extends from said first main semicircular channel and a second annular groove extends from said second main semicircular channel.

13. A pump according to claim 12, wherein said second annular groove is in fluid communication with said second main semicircular channel at a point adjacent to said outlet hole.

14. A pump according to claim 12, wherein said second annular groove is in fluid communication with said second main semicircular channel at a point adjacent to an end of said second main semicircular channel.

15. A pump according to claim 12, wherein said first annular groove is in fluid communication with said first main semicircular channel at a point adjacent to said inlet hole.

16. A pump according to claim 12, wherein said first annular groove is in fluid communication with said expanded portion of said first main semicircular channel.

17. A pump according to claim 11, wherein said first main semicircular channel and said second main semicircular channel extend approximately 330 degrees around one side of each of said cover and body pieces.

18. A pump according to claim 11, wherein said first main semicircular channel has a first end in fluid communication with said inlet hole and a second end.

19. A pump according to claim 18, wherein said second main semicircular channel has a first end substantially aligned with said second end of said first main semicircular channel and a second end in fluid communication with said outlet hole when said body and cover pieces are combined.

20. A pump according to claim 11, wherein said at least one annular groove remains at a substantially constant depth.

21. A pump comprising:

a housing defining an internal chamber;

an impeller disposed within said internal chamber;

an inlet hole defined within the housing below said impeller;

an outlet hole defined within the housing above said impeller;

a first main semicircular channel fluidly connected to said internal chamber and extending annularly around at least a portion of said housing below said impeller, wherein said first main semicircular channel expands outwardly at one end and terminates in an upward incline ramped towards said impeller;

a second main semicircular channel fluidly connected to said internal chamber and extending annularly around at least a portion of said housing above said impeller; and at least one annular groove extending from at least one of said first main semicircular channel and said second main semicircular channel.

22. A pump according to claim 21, wherein a first annular groove extends from said first main semicircular channel and a second annular groove extends from said second main semicircular channel.

23. A pump according to claim 22, wherein said first annular groove is in fluid communication with said expanded portion of said first main semicircular channel.

24. A method for routing contaminants substantially around an impeller in a pump assembly, having an inlet and an outlet, said method comprising the steps of:

providing a first main semicircular channel extending arcuately within a housing along which a first annular groove extends along the edge of at least a portion of said first main semicircular channel;

providing a second main semicircular channel extending arcuately within a housing along which a second annular groove opens along the edge of at least a portion of said second main semicircular channel;

rotating said impeller within said housing forcing said contaminants into said first and second annular grooves; and conveying said contaminants within said first and second annular grooves to said outlet.

25. A method for routing contaminants substantially around an impeller in a pump assembly, having an inlet and an outlet, said method comprising the steps of:

providing a first main semicircular channel extending within a housing;

providing a second main semicircular channel extending within a housing;

providing at least one annular groove opening along the edge of at least a portion of at least one of said first main semicircular channel and said second main semicircular channel;

rotating said impeller within said housing forcing said contaminants into said at least one annular groove; and conveying said contaminants within said at least one annular groove to said outlet.

* * * * *